US011512565B2

(12) United States Patent
Bryant et al.

(10) Patent No.: US 11,512,565 B2
(45) Date of Patent: Nov. 29, 2022

(54) PLASTIC WEIGHT ASSEMBLY FOR DOWNHOLE PERFORATING GUN

(71) Applicant: Halliburton Energy Services, Inc., Houston, TX (US)

(72) Inventors: Camille Anne Bryant, Cleburne, TX (US); Christopher C Hoelscher, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 178 days.

(21) Appl. No.: 17/108,877

(22) Filed: Dec. 1, 2020

(65) Prior Publication Data

US 2022/0170348 A1 Jun. 2, 2022

(51) Int. Cl.
*E21B 43/119* (2006.01)
*E21B 43/116* (2006.01)

(52) U.S. Cl.
CPC ..... *E21B 43/119* (2013.01); *E21B 43/116* (2013.01)

(58) Field of Classification Search
CPC ..... E21B 43/116; E21B 43/119
See application file for complete search history.

(56) References Cited

U.S. PATENT DOCUMENTS 5,964,294 A * 10/1999 Edwards ..... E21B 43/11852 166/242.6
6,679,327 B2 * 1/2004 Sloan ..... E21B 43/119 175/4.51
6,732,798 B2 5/2004 Johnson et al.
7,409,993 B2 8/2008 Han et al.
7,934,558 B2 * 5/2011 Hales ..... E21B 43/119 166/50
8,347,963 B2 1/2013 Johnson et al.
8,439,114 B2 5/2013 Parrott et al.
9,115,572 B1 8/2015 Hardesty et al.
10,689,955 B1 6/2020 Mauldin et al.
2011/0094743 A1 4/2011 Hales et al.
2011/0136707 A1 6/2011 Xu et al.
2019/0264548 A1 8/2019 Zhao et al.
2019/0284889 A1 9/2019 Lagrange et al.

FOREIGN PATENT DOCUMENTS

GB 2399583 A 9/2004
WO WO 2019/117861 A1 6/2019

OTHER PUBLICATIONS

Search Report issued for International Patent Application No. PCT/US2021/017692, dated Aug. 18, 2021, 16 pages.

* cited by examiner

*Primary Examiner* — Joshua T Semick
(74) *Attorney, Agent, or Firm* — John Wustenberg; C. Tumey Law Group PLLC

(57) ABSTRACT

A downhole perforating gun having a weight assembly formed of a plastic shell containing a weight material enclosed or encased in the plastic shell so that upon detonation of a perforating charge, the plastic shell may deform but will function to contain the weight material of the weight assembly preventing interference with formation fluid flow. In an alternative embodiment, the plastic shell is consumed by the detonation of the charges. In one or more embodiments, the plastic shell is hollow, forming a cavity into which a flowable weight material may be charged. The flowable weight material may be a granular material or a liquid, and may be selected based on the density characteristics of the flowable weight material and the weight requirements for a particular internally orienting perforating gun.

20 Claims, 9 Drawing Sheets

PLASTIC WEIGHT ASSEMBLY FOR DOWNHOLE PERFORATING GUN

TECHNICAL FIELD OF THE INVENTION

This invention relates, in general, to perforating a wellbore that traverses a fluid bearing subterranean formation and, in particular, to a weight system used to dynamically adjust the center of gravity of a perforating gun in order to orient charges carried by the perforating gun.

BACKGROUND OF THE INVENTION

After drilling the various sections of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore with cement disposed between the exterior of the casing string and the wellbore wall. To produce formation fluids into the casing string, hydraulic openings or perforations must be made through the casing string, the cement and a short distance into the formation.

Typically, these perforations are created by detonating a series of charges carried by a perforating gun positioned within the casing string adjacent a desired location for production. Specifically, one or more tubular gun carriers of the perforating gun are loaded with charges interconnected with a detonating device, such as detonating cord. The gun carriers are positioned in the wellbore at the end of a tubing string, wireline, slick line, coil tubing or the like. Once the gun carriers are properly positioned in the wellbore such that the shaped charges are adjacent to the formation to be perforated, the shaped charges are detonated. Upon detonation, the shaped charges create jets that blast through the wall of the gun carrier. Each jet creates a hydraulic opening through the casing and the cement and enters the formation forming a perforation.

It has been found, however, that it is sometimes desirable to perforate a wellbore in a particular direction or range of directions relative to the wellbore. For example, in a deviated, inclined or horizontal well, it is frequently beneficial to form perforations in the upward direction, the downward direction or both. Attempts have been made to achieve this goal of perforating wells in particular directions by rigidly mounting charges in the gun carrier of a perforating gun so that the charges are pointed in a desired direction relative to the gun carrier. The perforating gun is then conveyed into a wellbore and laterally biased to one side of the wellbore so that the perforating gun seeks the lower portion of the wellbore due to gravity. More recently, perforating guns may include a charge tube within the gun carrier, multiple perforating charges, multiple charge mounting structures and multiple rotating supports with weights formed of metal disposed in the charge tube to urge the charge tube to internally orient relative to the gun carrier to position the perforating charges to shoot in a desired direction in a well. Upon detonation of the perforating charges, the metal weights may fragment releasing metal shards into the wellbore and interfering with fluid flow from the formation.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Disclosed herein are embodiments of a downhole perforating gun having a weight assembly formed of a plastic shell containing a weight material enclosed or encased in the plastic shell so that upon detonation of a perforating charge, the plastic shell may deform but will function to contain the weight material of the weight assembly. In one or more embodiments, the plastic shell is hollow, forming a cavity into which a flowable weight material may be charged. The flowable weight material may be a granular material or a liquid, and may be selected based on the density characteristics of the flowable weight material and the weight requirements for a particular internally orienting perforating gun. In other embodiments, the plastic shell may be disposed around a solid weight material. In yet other embodiments, the plastic shell may be solid or hollow, but impregnated with or otherwise suspending the weight material. In such embodiments, the weight system may be formed of alternating layers of plastic and weight material as may be achieved, in some embodiments, by three-dimensional printing. In any event, the plastic shell is sufficiently rigid to support the weight material prior to detonation of perforating charges, but sufficiently malleable upon detonation of the perforating charges so as to deform without fracturing, encasing the weight material and thereby ensuring that neither the weight material nor the plastic shell are released into the wellbore. In other embodiments, the plastic shell may be the weight material and substantially consumed by the detonation of the charges, thus resulting in minimal debris that could interfere with formation fluid flow.

Figure 1:
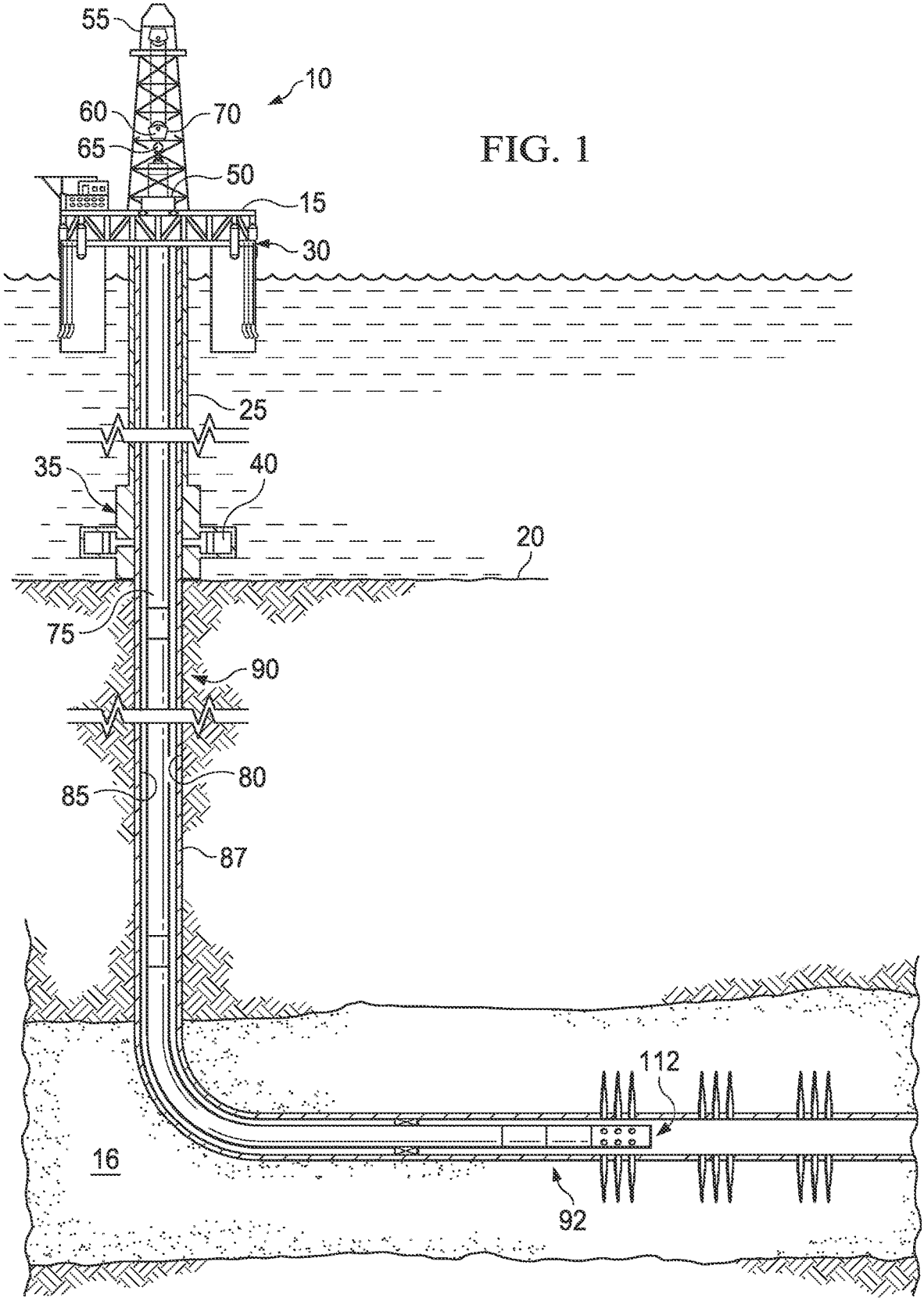
FIG. 1 is a schematic illustration of an offshore oil and gas platform operating a plurality of apparatuses for dynamically adjusting the center of gravity of a downhole perforating gun.

Referring to FIG. 1, in an embodiment, an offshore oil and gas rig is schematically illustrated and generally referred to by the reference numeral 10. The offshore oil and gas rig 10 includes a semi-submersible platform 15 that is positioned over a submerged oil and gas formation 16 located below a sea floor 20. A subsea conduit 25 extends from a deck 30 of the platform 15 to a subsea wellhead installation 35. One or more pressure control devices 40, such as, for example, blowout preventers (BOPs), and/or other equipment associated with drilling or producing a wellbore may be provided at the subsea wellhead installation 35 or elsewhere in the system. The platform 15 may also include a hoisting apparatus 50, a derrick 55, a travel block 60, a hook 65, and a swivel 70, which components are together operable for raising and lowering a conveyance string 75. The conveyance string 75 may be, include, or be part of, for example, a casing, a drill string, a completion string, a work string, a pipe joint, coiled tubing, production tubing, other types of pipe or tubing strings, and/or other types of conveyance mechanisms, such as wireline, slickline, and/or the like. The platform 15 may also include a kelly, a rotary table, a top drive unit, and/or other equipment associated with the rotation and/or translation of the conveyance string 75. A wellbore 80 extends from the subsea wellhead installation 35 and through the various earth strata, including the submerged oil and gas formation 16. At least a portion of the wellbore 80 includes a casing 85 cemented within wellbore 80 by cement 87. The conveyance string 75 is, includes, or is operably coupled to a perforating gun assembly 112 extending within the wellbore 80 and the casing 85 at a subterranean location.

Figure 2:
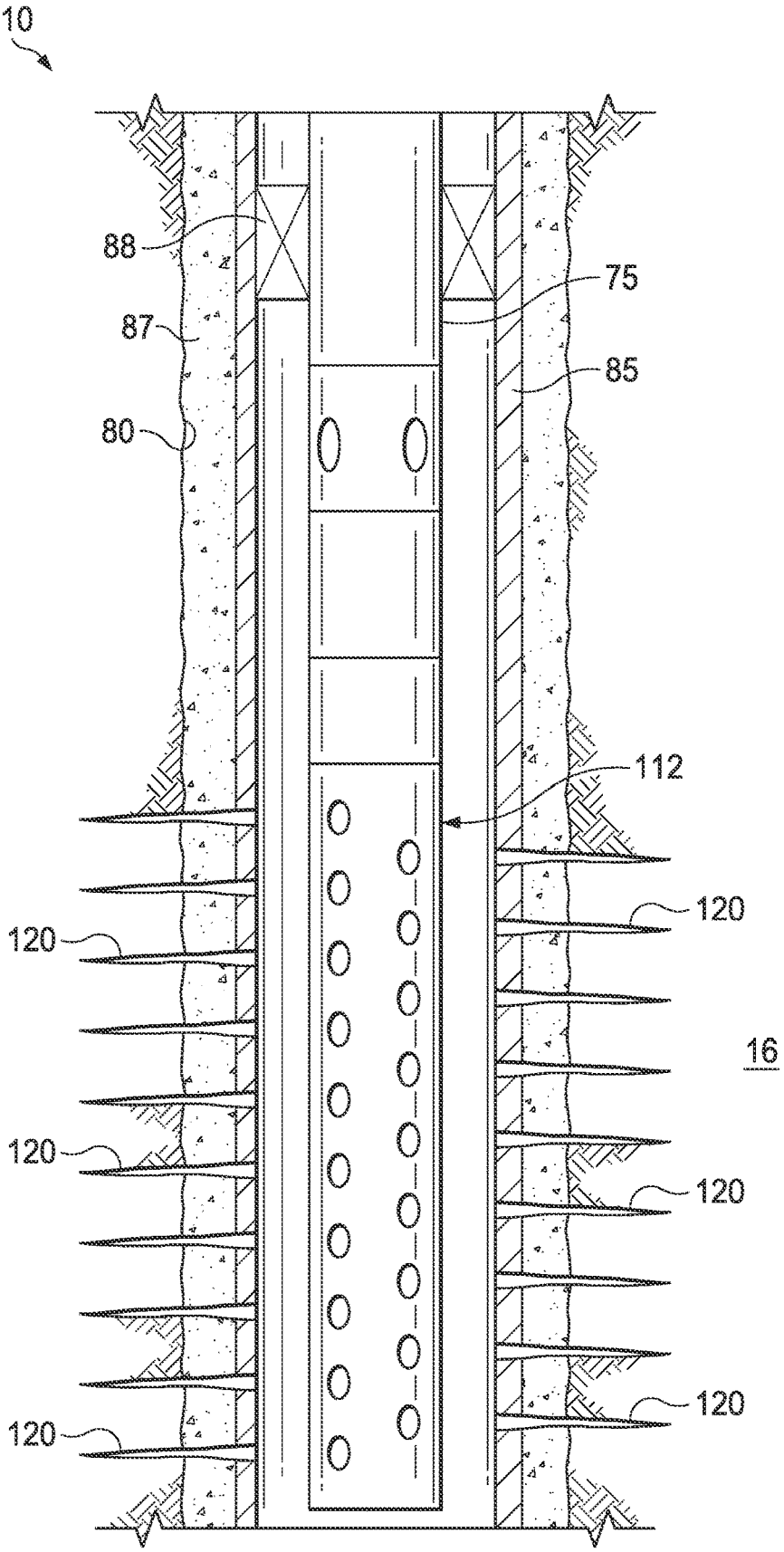
FIG. 2 is a schematic illustration of the perforating gun of FIG. 1 positioned with a wellbore adjacent a production of a formation.

Referring to FIG. 2, with continuing reference to FIG. 1, in an embodiment, perforating gun assembly 112 extends within the wellbore 80, which is lined with the casing 85 and cement 87. Conveyance string 75 may further include a packer 88 that may be sealingly engaged with casing 85 to isolate a production zone within formation 16 adjacent perforating gun assembly 112. In any event, the perforating gun assembly 112 is operable to form perforations 120 through the casing 85 and the cement 87 so that fluid communication is established between the interior of casing 85 and the oil and gas formation 16 surrounding the wellbore 80. The perforating gun assembly 112 includes perforating charges 124 (shown in FIG. 3; not visible in FIG. 2) that are detonatable to form the perforations 120 through the casing 85 and the cement 87.

In the illustrated embodiment of FIG. 1, wellbore 80 has an initial, generally vertical portion 90 and a lower, generally deviated portion 92 which is illustrated as being horizontal in FIG. 1, with perforating gun assembly 112 positioned in the deviated portion 92. In the illustrated embodiment of FIG. 2, wellbore 80 is shown with perforating gun assembly 112 positioned in a generally vertical portion 90 of wellbore 80. It should be noted, however, by those skilled in the art that the perforating gun assembly 112 as described herein is not limited to operation in a wellbore portion of a certain orientation but is equally well-suited for use in other well configurations including, but not limited to, inclined wells, wells with restrictions, non-deviated wells, multilateral wells and the like. In addition, even though an offshore operation has been depicted in FIG. 1, the perforating gun assembly 112 is equally well-suited for use in onshore operations.

Figure 3:
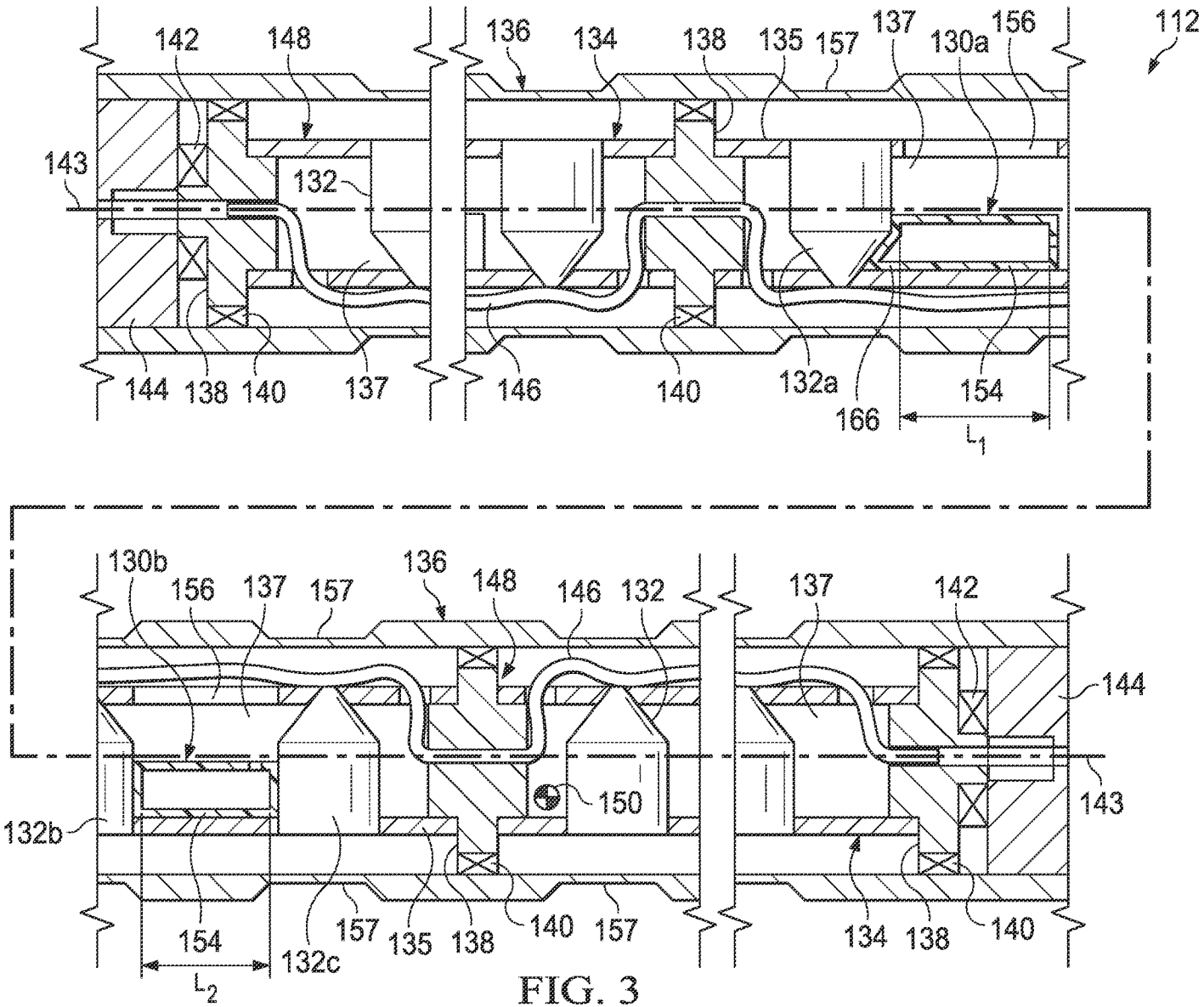
FIG. 3 is a cross-sectional view of one embodiment of a perforating gun having unique plastic weight assemblies for dynamically adjusting the center of gravity of the downhole perforating gun.

Referring now to FIG. 3, therein is depicted a perforating gun assembly 112 apparatus that includes one or more weight assemblies, each generally designated as 130. In the following description of each weight assembly 130, as well as the other apparatuses and methods described herein, directional terms such as "above", "below", "upper", "lower" and the like are used for convenience in referring to the illustrations as it is to be understood that the various embodiments of the invention may be used in various orientations such as inclined, inverted, horizontal, vertical and the like and in various configurations, without departing from the principles of the invention.

Gun assembly 112 includes a plurality of shaped charges 132 that are mounted in a charge holder that is depicted as charge tube 134 having an exterior wall 135. It will be appreciated that each gun assembly 112, and in particular, the positioning and shape of charges 132 may be unique to the particular perforating job for which the gun assembly 112 is deployed. As such, the interior spaces 137 of each gun assembly 112 may differ, making it difficult in some cases to mass produce a weight system 130 that can fully fill the interior space 137 of any specific gun assembly 112. Notably, in the prior art, mass produced, solid metal weights have been utilized, where the dimensions for such prior art weights have standard sizes and dimensions so that they can be mounted in any a variety of perforating gun assemblies. A drawback to these prior art weights is that they must be sized sufficiently small to fit all interior spaces 137 across a range of gun assembly configurations, and thus, may not necessarily use the greatest volume of interior space available within a particular gun assembly in order to maximize the amount of weight that could be added to the prior art gun assembly. Alternatively, complex geometries require a high degree of machinability of the prior art weights in order to fully utilize the empty spaces 137 between charges, thus greatly increasing the costs associated with manufacturing the prior art weights for a particular empty space 137.

In any event, charge tube 134 formed of a cylinder wall 135 is rotatably mounted within gun carrier 136. Preferably, charge tube 134 is made from cylindrical tubing, but it should be understood that it is not necessary for charge tube 134 to be tubular or have a cylindrical shape in keeping with the principles of the invention. Charge tube 134 includes multiple supports 138 that allow charge tube 134 to rotate within gun carrier 136. This manner of rotatably supporting charge tube 134 prevents charges 132 or any other portion of charge tube 134 from contacting the interior of gun carrier 136.

Each of the supports 138 includes rolling elements or bearings 140 contacting the interior of gun carrier 136. For example, bearings 140 could be ball bearings, roller bearings, plain bearings or the like. Bearings 140 enable supports 138 to suspend charge tube 134 in gun carrier 136 and permit rotation thereof. In addition, optional thrust bearings 142 may be positioned between each end of charge tube 134 and gun carrier 136 such that thrust hearings 142 contact devices 144 attached at each end of gun carrier 136. Each device 144 may be tandems that are used to couple two guns to each other, a bull plug used to terminate a gun string, a firing head, or any other type of device which may be attached to gun carrier 136. As with bearings 140 described above, thrust bearings 142 may be any type of bearings. Thrust bearings 142 support charge tube 134 against axial loading within gun carrier 136, while permitting charge tube 134 to rotate within gun carrier 136.

Charge tube 134, charges 132 and other portions of gun 112 supported in gun carrier 136 by the supports 138 including, for example, a detonating cord 146 extending to each of the charges and portions of the supports themselves, are parts of an overall rotating assembly 148. By offsetting a center of gravity 150 of assembly 148 relative to a longitudinal rotational axis 143 of bearings 140, rotating assembly 148 is biased by gravity to rotate to a specific position in which the center of gravity 150 is located directly below the rotational axis 143.

Rotating assembly 148 may, due the construction of the various elements thereof, initially may have the center of gravity 150 in a desired position relative to charges 132, such as along rotational axis 143. However, to ensure that charges 132 are directed to shoot in respective predetermined directions, the center of gravity 150 may be repositioned using weight assembly 130 that includes at least a partial plastic exterior 154. While weight assembly 130 is most preferably carried by charge tube 134 in order to actuate rotating assembly 148, in other embodiments, weight assembly 130 may simply be mounted within gun carrier 136. Regardless, it will be appreciated that there may be a desire to maximize weight within gun assembly 112 to achieve a certain center of gravity.

To the extent a weight assembly 130 is installed in charge tube 134, an access window 156 may be formed in the cylinder wall 135 of charge tube 134 to allow weight assembly 130 to be inserted into and positioned within charge tube 134.

In the illustrated embodiment, on the left side of FIG. 3, a weight assembly 130*a* is added to rotating assembly 148 to direct the charges 132 to shoot upward, while on the right side of FIG. 2, a weight assembly 130*b* is added to rotating assembly 148 to direct the charges 132 to shoot downward. As discussed in greater detail below, weight assemblies 130 may be otherwise positioned to direct the charges 132 to shoot in any desired direction, or combination of directions and to avoid shooting in undesired directions.

In some embodiments, gun carrier 136 may be provided with reduced wall thickness portions 157, which extend circumferentially about carrier 136 outwardly overlying each of the charges 132. Thus, as the charges 132 rotate within carrier 136, they remain directed to shoot through the portions 156. The reduced wall thickness portions 157 may be formed on carrier 136 by rolling, forging, lathe cutting or any other suitable technique. In other embodiments, reduced wall thickness portions 157 may be eliminated and charges 132 simply shoot through the wall of gun carrier 136.

Figure 4A:
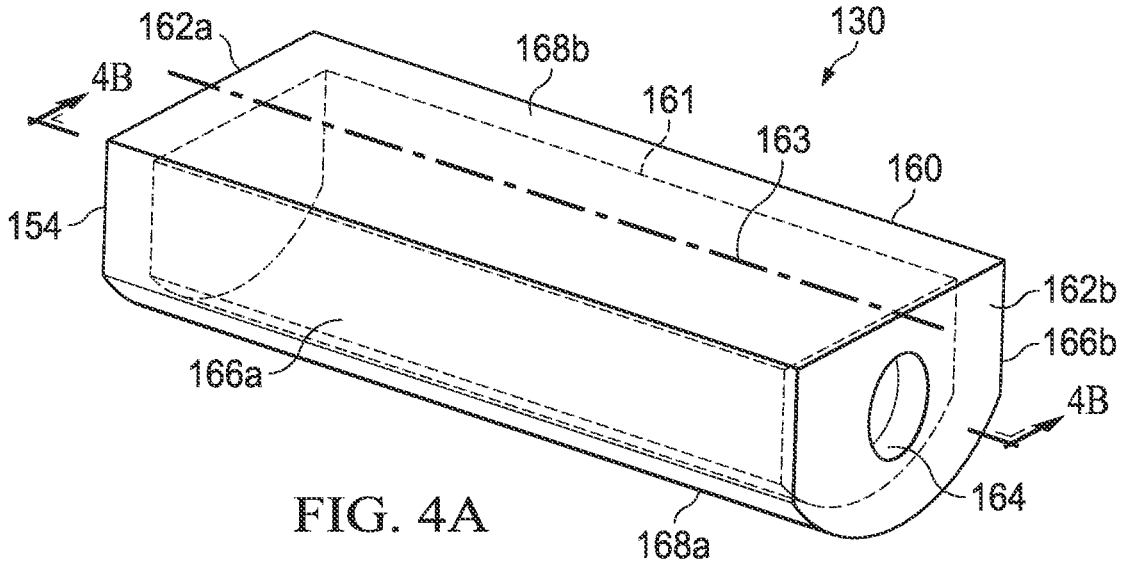
FIGS. 4A-4B are perspective and cross-sectional views of one embodiment of a hollow plastic weight assembly employed to dynamically adjust the center of gravity of a downhole perforating gun.

Referring to FIG. 4A, a perspective view of one an embodiment of weight assembly 130 is shown in more detail. In the illustrated embodiment, plastic exterior 154 of weight assembly 130 forms a plastic shell 160 defining a hollow portion or cavity 161 therein. As will be described below, weight assembly 130 may be shaped to fit within a particular interior space 137. In the illustrated embodiment, plastic shell 160 extends along a weight assembly axis 163 and has a first end wall 162*a* and a second end wall 162*b* and spaced apart side walls 166*a*, 166*b*. An outer wall 168*a* extends between first and second ends 162*a*, 162*b* and an inner wall 168*b* is spaced apart from outer wall 168*a*. While shown as generally rectangular in shape, plastic shell 160 may have any shape as desired. In the illustrated embodiment, outer wall 168*a* is shown as arcuate in shape to correspond with the tubular wall 135 of charge tube 134. An aperture 164 may be formed in plastic shell 160 to permit fluid communication with cavity 161 as described below.

It will be appreciated that for purposes of the disclosure, plastic exterior 154 is formed of a synthetic or naturally occurring polymer, that may be shaped when soft and then hardened to retain the given shape. In one or more embodiments, plastic exterior 154 may be formed of any one of polyethylene terephthalate (PETE or PET), high-density polyethylene (HDPE), polyvinyl chloride (PVC), polypropylene (PP), polycarbonate, polylactide, acrylic, fiberglass, or nylon so long as the plastic exterior 154 will either plastically deform under high temperature and/or high pressure resulting from a detonation of charges 132, while generally functioning to contain a weight material as described below, or be completely consumed by charge detonation in accordance with the descriptions herein. It will be appreciated that the forgoing list of possible polymer materials is illustrative only and the discussion herein is not intended to be limited thereby.

In one or more embodiments, plastic shell 160 may be formed by three-dimensional (3D) printing. In other embodiments, plastic shell 160 may be molded or cast. One benefit to 3D printing of plastic shell 160 is that plastic shell 160 may be manufactured specifically to fit in a unique interior space 137 within charge tube 104, such as between adjacent charges 132, in order to maximize use of the space. Specifically, 3D printing would allow the plastic shell 160 to be manufactured to more fully fill an interior space 137 and is readily manufacturable on demand with little or no increase in cost. Thus, referring back to FIG. 3, weight assembly 130*a* is shown shaped as an elongated rectangle having a first length L1 but manufactured with a triangular end 166 to more fully fill interior space 137 around charge 132*a*. Weight assembly 130*b*, on the other hand, while rectangular, is shown shaped to have a second length L2 that is shorter than L1, allowing weight assembly 130*b* to be manufactured to fill the interior space 137 between adjacent charges 132*b*, 132*c*. In this illustration, the ends of weight assembly 130*b* are square, again in order to maximize use of the interior space 137 between charges 132*b*, 132*c*. In another embodiment, L1 may represent the distance between a first and second charge 132, while L2 may represent the distance between second and third charges, such as charges 132*b* and 132*c* as shown. Weight assembly 130*a* may be manufactured to substantially extend between the first and second charges and thus have a length of approximately L1, while weight assembly 130*b* may be manufactured to substantially extend between the second and third charges and thus have a length of approximately L2. As such, each weight assembly 130*a*, 130*b* is uniquely manufactured to maximize use of the interior space 137 between adjacent charges.

Figure 4B:
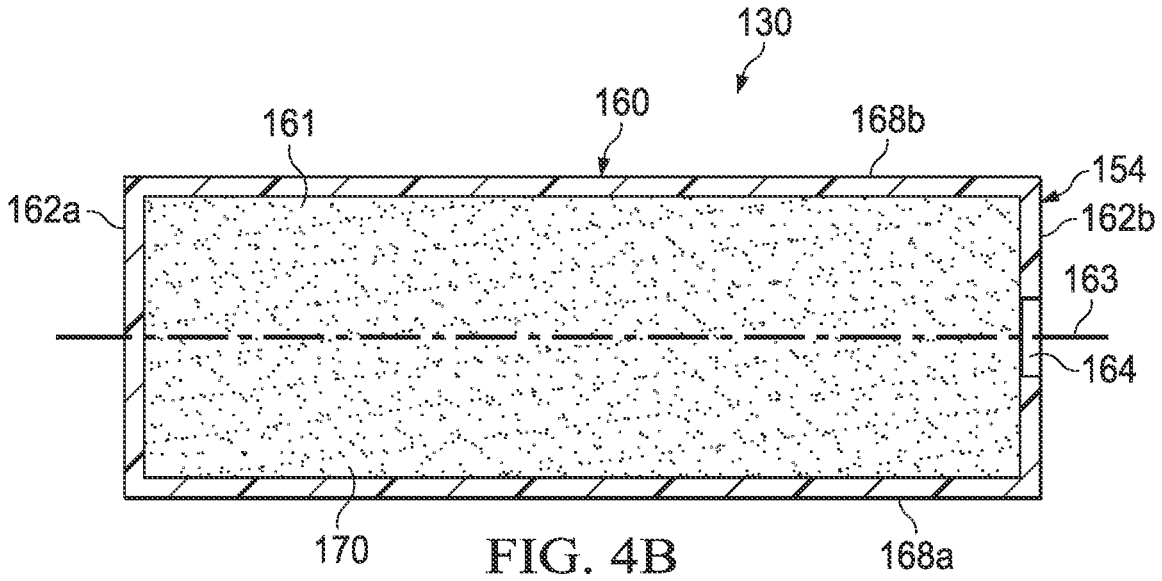

Weigh assembly 130 of FIG. 4A is shown in cross-section in FIG. 4B. In this embodiment, weight assembly 130 includes a cavity 161 which may be filled with a weight material 170 which may be selected to achieve a desired weight for weight assembly 130. In one or more embodiments, weight material 170 may be solid, while in other embodiments, weight material 170 is a flowable material, characterized as a material that can flow at normal temperature and pressure, namely 20° C. (293.15 K, 68° F.) and an absolute pressure of 1 atm (14.696 psi, 101.325 kPa), respectively. In some embodiments, flowable weight material 170 may be a liquid, such as water, a gel, paste or slurry, while in other embodiments, flowable weight material may be a granular material in the form of a solid, such as sand or powder or pellets or balls, or beads. In yet other embodiments, the flowable weight material may consist of a liquid in which granular solids are suspended. In one nonlimiting example, the flowable weight material may be gel in which metallic pellets are suspended. As described herein, during a discharge event, in some embodiments, plastic shell 160 has sufficient plasticity that it may deform but will not rupture or fracture, thus preventing the release of the flowable weight material 170 into the wellbore. In this regard, plastic shell 160 may become a molten mass that binds the weight material 170 upon detonation of charges 132.

In yet other embodiments, particularly where the plastic shell 160 forms part of weight material 170, the plastic shell 170 may be substantially or completely consumed by the detonation of charges 132. For example, in one or more embodiments, plastic shell 160 may be a heavy plastic material such as tungsten filled polyether block amide (PEBA). These materials can be formulated to have high density compounds of thermoplastics that may incorporate a high-density powder such as tungsten, molybdenum, silver, lead, mercury, tantalium, rhenium, platinum, iridium or the like. When the plastic shell 160 is consumed, any remaining powder would be de minimis with respect to interfering with formation fluid flow, but instead, would be carried away by such fluid flow.

Figure 5A:
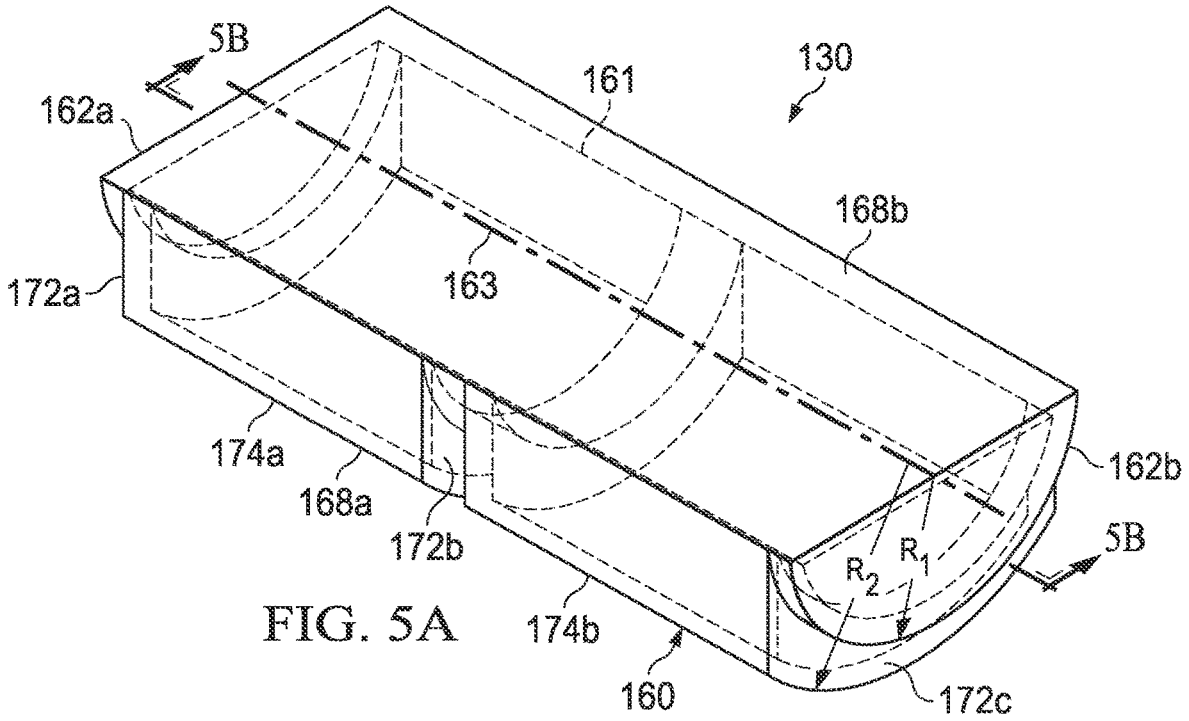
FIGS. 5A-5B are perspective and cross-sectional views of another embodiment of a hollow plastic weight assembly employed to dynamically adjust the center of gravity of a downhole perforating gun.

Turning to FIG. 5A, a perspective view of another embodiment of weight assembly 130 is illustrated. In the embodiment of FIG. 5, weight assembly 130 is shown as having a particular shape selected to fit within a select space within charge tube 134 as described above. In this embodiment plastic shell 160 has a first end 162*a* and a second end 162*b*. An outer wall 168*a* extends between first and second ends 162*a*, 162*b* and an inner wall 168*b* is spaced apart from outer wall 168*a*. In this embodiment, outer wall 168*a* transitions between a first radius R1 and a second radius R2, thereby forming one or more notches 172*a*, 172*b* and 172*c* in outer wall 168*a* to accommodate a particular shape. In the illustrated embodiment, notches 172*a* and 172*b* define a first extension 174*a* and notches 172*b* and 172*c* define a second extension 174*b*. A cavity XX is shown in dashed lines formed within plastic shell 160.

Figure 5B:
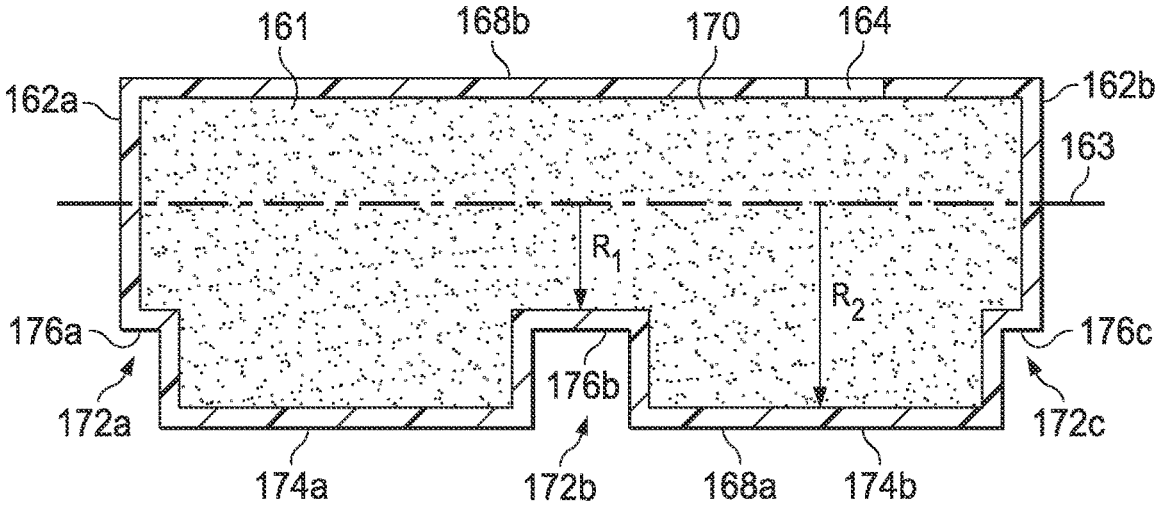

Weigh assembly 130 of FIG. 5A is shown in cross-section in FIG. 5B. In this embodiment, weight assembly 130 includes a cavity 161 which may be tilled with a weight material 170, which may be flowable as described above, and which may be selected to achieve a desired weight for weight assembly 130. Notches 172*a*, 172*b* and 172*c* are shown formed in outer wall 168*a* to define extensions 174*a*, 174*b*. In the illustrated embodiment, each notch 172*a*, 172*b*, 172*c* is of a first radius R1 and each extension 174*a*, 174*b* is of a second radius R2, thereby forming shoulders 176*a*, 176*b*, 176*c*.

Figure 6:
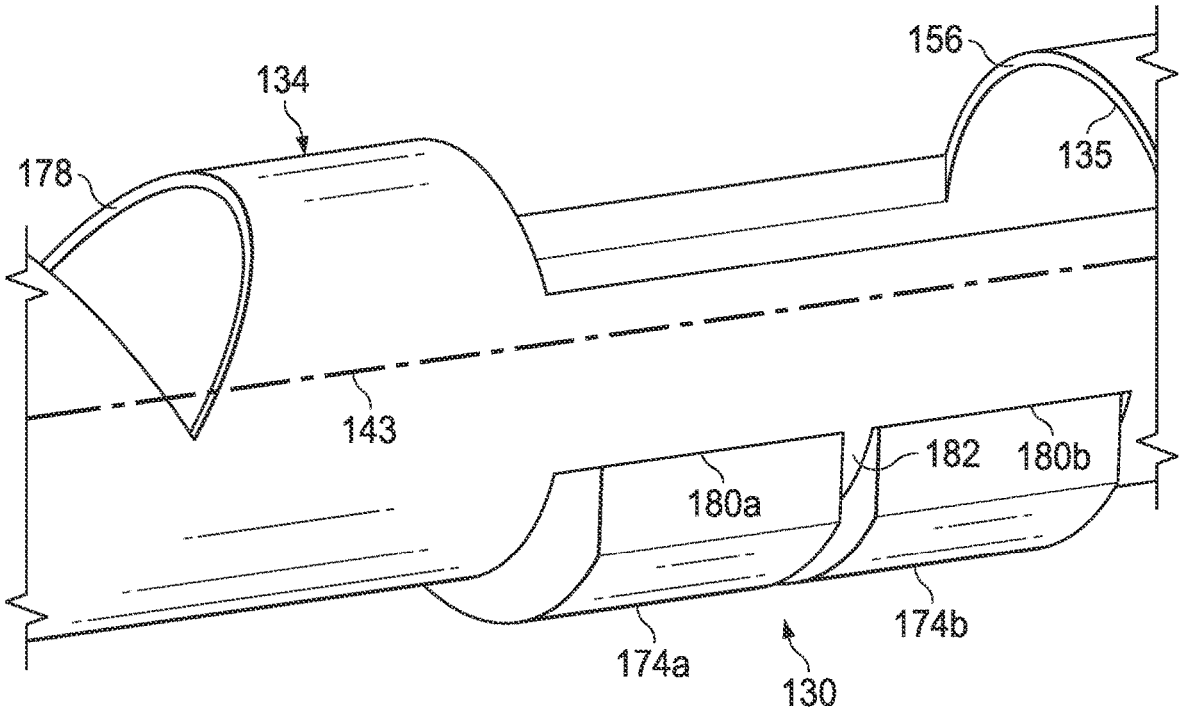
FIG. 6 is a perspective view of the charge tube of a downhole perforating gun with a plastic weight assembly deployed therein.

Turning to FIG. 6, with ongoing reference to FIGS. 5A and 5B, the shaped weight assembly 130 of FIGS. 5A and 5B is shown installed in a charge tube 134. In the illustrated embodiment, charge tube 134 is formed in a cylinder wall 135 in which one or more charge windows 178 are disposed generally adjacent a charge 132 (see FIG. 3). Likewise, an access window 156 may be defined in cylinder wall 135 to permit weight assembly 130 to be inserted into and positioned within charge tube 134. One or more extension windows 180 may also be defined in cylinder wall 135. In the illustrated embodiment, a first extension window 180*a*, and a second extension window 180*b* are shown defined in cylinder wall 135 opposite access window 156. First and second extension windows 180*a*, 180*b* are axially spaced apart from one another so that cylinder wall 135 forms a rib 182 between extension windows 180*a*, 180*b*. Weight assembly 130 is shown mounted in charge tube 134 so that extensions 174*a*, 174*b* protrude through extension windows 180 and shoulders 176 seat against cylinder wall 135. In this embodiment, therefore, weight assembly 130, while seated within charge tube 134, extends through extension windows 180, thus moving the center of gravity 150 (see FIG. 3) even farther away from the rotational axis 143 of gun assembly 112.

Figure 7:
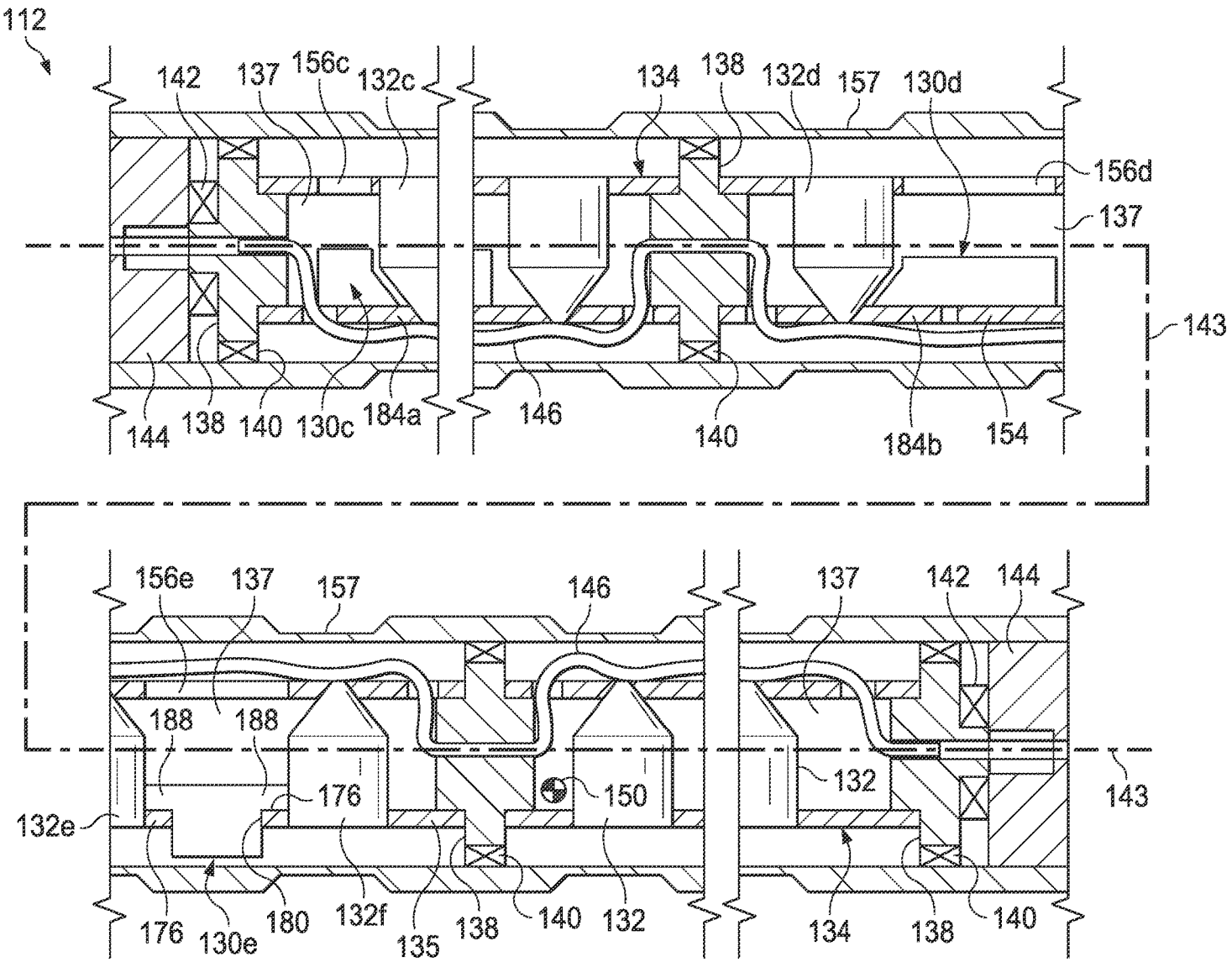
FIG. 7 is a cross-sectional view of another embodiment of a perforating gun having unique plastic weight assemblies for dynamically adjusting the center of gravity of the downhole perforating gun.

FIG. 7 illustrates other embodiments of weight assembly 130. On the left most side of FIG. 7, a weight assembly 130*c* is added to rotating assembly 148 to direct the charges 132 to shoot upward. As shown, weight assembly 130*c* is uniquely manufactured to maximize weight distribution at portion 184*a* of cylinder wall 135 along which weight assembly 130*c* is disposed. In the illustration, the interior space 137 around charge 132*c* includes an open rectangular area around the proximal end of charge 132*c* adjacent portion 184 of cylinder wall 135. Because plastic shell 160 can be uniquely manufactured for this interior space, such as through 3D printing of plastic shell 160, the weight distribution adjacent portion 184*a* of cylinder wall 135 can be maximized at that location. Likewise, a weight assembly 130*d* is uniquely manufactured to maximize weight distribution at portion 184*b* of cylinder wall 135 along which weight assembly 130*d* is disposed. In the illustration, the interior space 137 around charge 132*d* includes an open rectangular area around the proximal end of charge 132*d* adjacent portion 184*b* of cylinder wall 135. Because plastic shell 160 can be uniquely manufactured for this interior space, such as through 3D printing of plastic shell 160, the weight distribution adjacent portion 184*b* of cylinder wall 135 can be maximized at that location. The differences in the shapes of the interior space 137 adjacent charge 132*c* and charge 132*d* highlight the flexibility of a 3D printed or molded plastic shell 160. As can be seen, although both are manufactured to fit around a charge 132, weight assembly 130*c* is smaller than weight assembly 130*d* because of the differences in available interior space 137 around each charge 132*c*, 132*d*. In each case, an access window 156*c*, 156*d* may be formed in the cylinder wall 135 opposite weight assemblies 130*c*, 130*d*, respectively, to allow weight assemblies 130*c*, 130*d* to be inserted into charge tube 134.

On the right side of FIG. 7, weight assembly 130*e* illustrates another embodiment wherein weight assembly 130*e* protrudes through an extension window 180 formed in cylinder wall 135, so that the distance between axis 143 and the center of gravity of weight assembly 130*e* can be maximized. In this embodiment, weight assembly 130*e* is shaped to include shoulders 176 that abut cylinder wall 135 with flanges 188 that extend fully between adjacent charges 132*e*, 132*f*, thereby maximizing use of the interior space 137 between charges 132*e*, 132*f*. An access window 156*e* may be formed in the cylinder wall 135 opposite weight assembly 130*e* to allow weight assembly 130*e* to be inserted into charge tube 134.

Except as may otherwise be described herein, it will be appreciated that the disclosure is not limited to a particular device or method for mounting or otherwise securing weigh assemblies 130 in charge tube 134 or gun carrier 136. In some embodiments, any fastener known in the art may be utilized including screws, clips or pins, which in some embodiments, may be plastic fasteners integrally formed as part of plastic shell 160. In some embodiments, weight assembly 130 may be manufactured to be fit between adjacent components within charge tube 134 without the use of fastening devices. In one example, in FIG. 7, weight assembly 130*e* may be manufactured to be press fit between charges 132*e* and 132*f*. Because plastic shell 160 is deformable, it will be appreciated that plastic shell 160 may be readily press fit between elements within charge tube 134.

Figure 8:
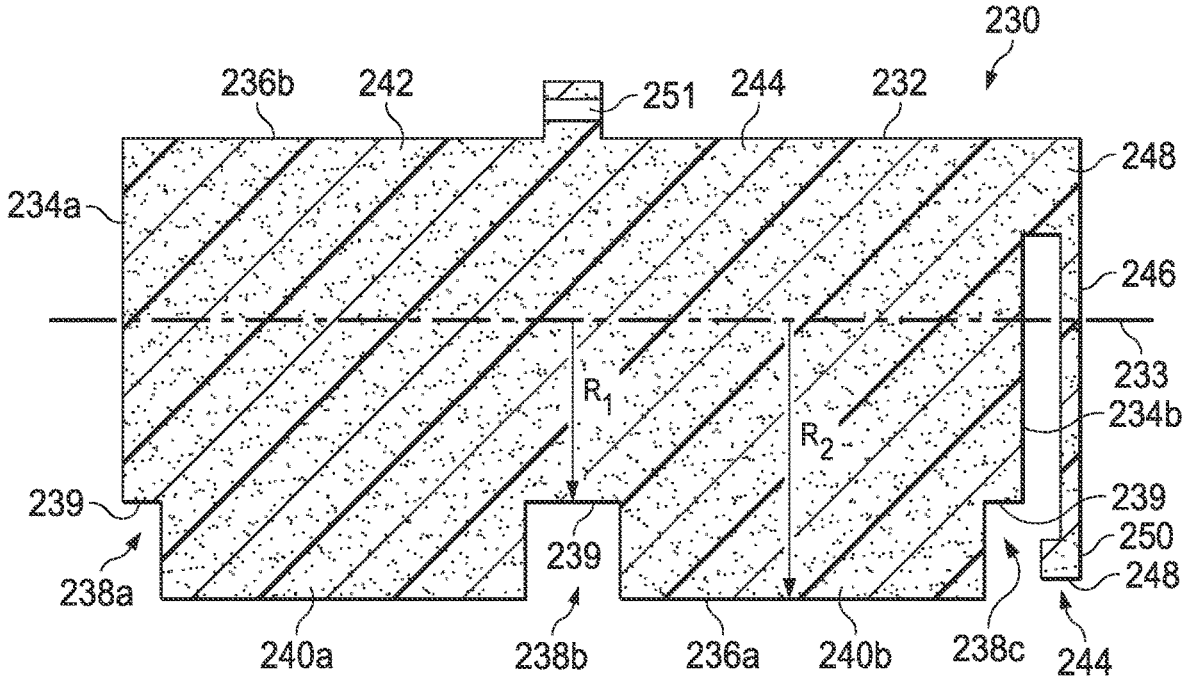
FIG. 8 cross-sectional views of one embodiment of a solid-core plastic weight assembly employed to dynamically adjust the center of gravity of a downhole perforating gun.

Turning to FIG. 8, another embodiment of weight assembly 130 is shown and designated as weight assembly 230. In the illustrated embodiment, weight assembly 230 is formed of a plastic shell 232, having a first end 234*a* and a second end 234*b* and extending along a weight assembly axis 233. An outer side 236*a* extends between first and second ends 234*a*, 234*b* and an inner side 236*b* is spaced apart from outer side 236*a*. In this embodiment, outer side 236*a* transitions between a first radius R1 and a second radius R2, thereby forming one or more notches 238*a*, 238*b* and 238*c* along outer side 236*a* to accommodate a particular shape. In the illustrated embodiment, notches 238*a* and 238*b* define a first extension 240*a* and notches 238*b* and 238*c* define a second extension 240*b*. In the illustrated embodiment, each notch 238*a*, 238*b*, 238*c* is of a first radius R1 and each extension 240*a*, 240*b* is of a second radius R2, thereby forming shoulders 239*a*, 239*b*, 239*c*.

Unlike certain embodiments of a weight assembly 130 described above that include a cavity (see FIGS. 4B and 5B), in this embodiment, plastic shell 232 has a solid plastic core 242 with a weight material 244 dispersed throughout plastic core 242. In one or more embodiments, weight material 244 may be metal pellets, balls, beads or other granular material that can be suspended in plastic core 242.

In one or more embodiments, any of the described weight assemblies 130, 230 may include a plastic clip 244 integrally formed as part of weight assembly such as is shown in weight assembly 230. In the illustrated embodiment, plastic clip 244 includes an elongated arm 246 secured to plastic shell 232 at a proximal arm end 248 and generally spaced apart from second end 234*b* of plastic shell 232. Elongated arm 246 includes a head 248 is formed at a distal arm end 250. Clip 244 may be integrally formed as part of plastic shell 232 or mounted thereto.

Likewise, other plastic features 251 may be integrally formed as part of plastic shell 232. In the illustrated embodiment, plastic feature 251 is a guide for detonating cord 146. It will be appreciated that because plastic shell 232 is printed, molded or otherwise formed plastic, it is much easier to include other elements such as plastic clip 244 or plastic guide 251 as an integral element of weight assembly 230.

Figure 9:
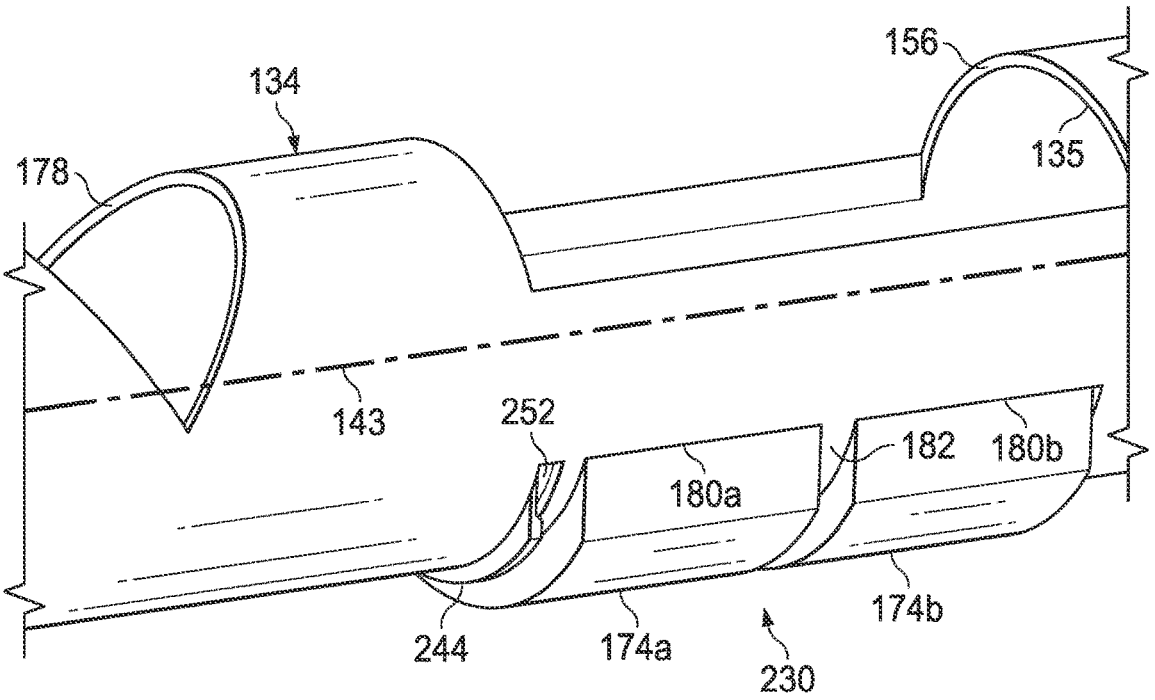
FIG. 9 is a perspective view of the charge tube of a downhole perforating gun with a plastic weight assembly deployed therein and secured by a clip.

FIG. 9 illustrates weight assembly 230 installed in a charge tube 134. As shown, charge tube 134 is formed in a cylinder wall 135 in which one or more charge windows 178 are disposed. Likewise, an access window 156 may be defined in cylinder wall 135 to permit weight assembly 230 to be inserted into and positioned within charge tube 134. One or more extension windows 180 may also be defined in cylinder wall 135. In the illustrated embodiment, a first extension window 180*a*, and a second extension window 180*b* are shown defined in cylinder wall 135 opposite access window 156. First and second extension windows 180*a*, 180*b* are axially spaced apart from one another so that cylinder wall 135 forms a rib 182 between extension windows 180*a*, 180*b*. Weight assembly 230 is shown mounted in charge tube 134 so that extensions 240*a*, 240*b* protrude through extension windows 180 and shoulders 176 seat against cylinder wall 135. In this embodiment, therefore, weight assembly 230, while seated within charge tube 134, extends through extension windows 180, thus moving the center of gravity 150 (see FIG. 3) even farther away from the axis 143 of gun assembly 112 than if weight assembly 230 were simply contained within charge tube 134. In one or more embodiments, a slot 252 may also be formed in cylinder wall 135 adjacent extension window 180*a*. As shown, slot 252 receives clip 244, and in particular, head 248 is shown to have passed through slot 252 and engages the exterior of cylinder wall 135, thereby securing weigh assembly 230 within charge tube 134.

Figure 10:
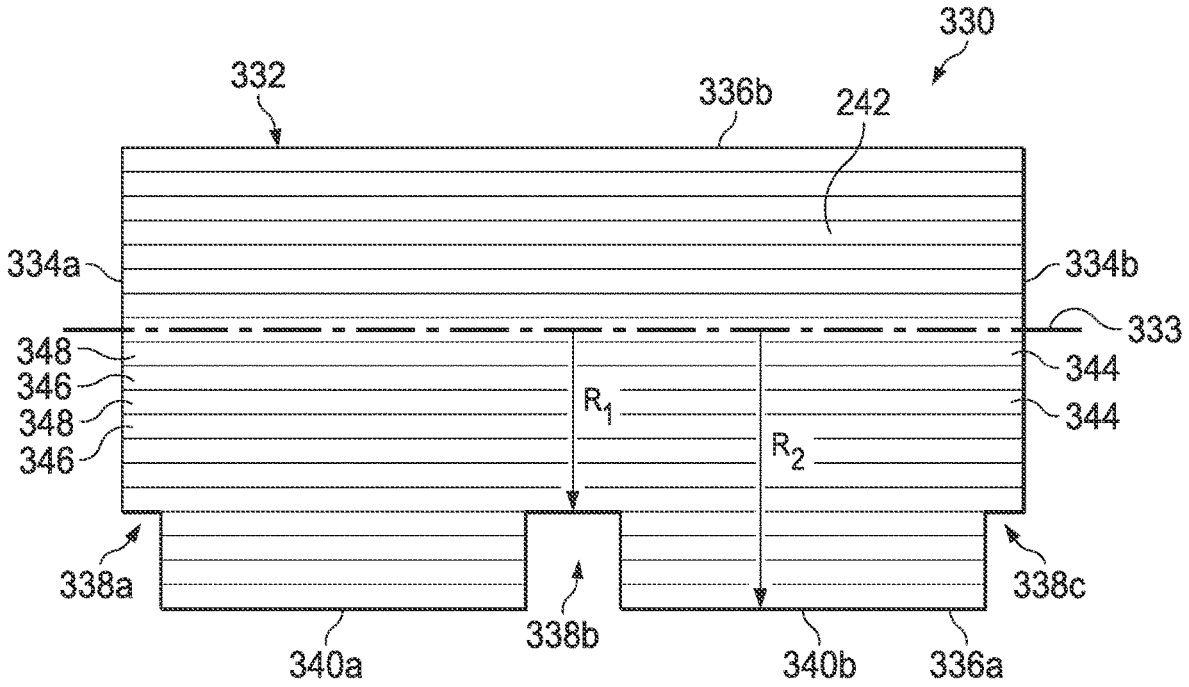
FIG. 10 is a cross-sectional view of another embodiment of a solid-core plastic weight assembly employed to dynamically adjust the center of gravity of a downhole perforating gun.

Turning to FIG. 10, another embodiment of weight assemblies 130, 230 is shown and designated as weight assembly 330. In the illustrated embodiment, weight assembly 330 is formed of a plastic shell 332 extending along weight assembly axis 333, and having a first end 334*a* and a second end 334*b*. An outer side 336*a* extends between first and second ends 334*a*, 334*b* and an inner side 336*b* is spaced apart from outer side 336*a*. In this embodiment, outer side 336*a* transitions between a first radius R1 and a second radius R2, thereby forming one or more notches 338*a*, 338*b* and 338*c* along outer side 336*a* to accommodate a particular shape. In the illustrated embodiment, notches 338*a* and 338*b* define a first extension 340*a* and notches 338*b* and 338*c* define a second extension 340*b*.

Figure 11:
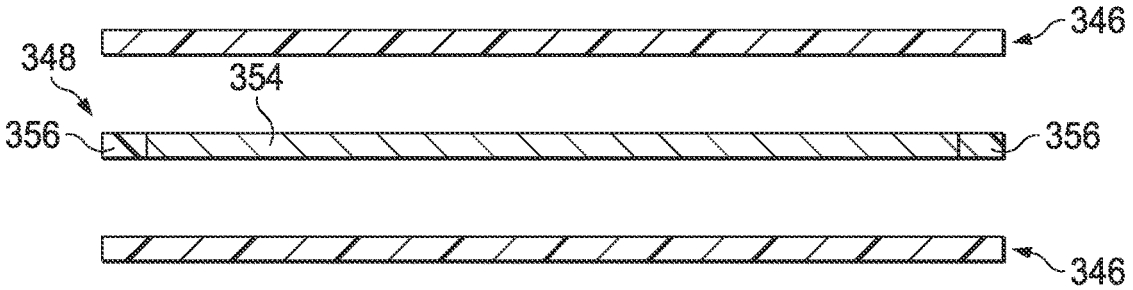
FIG. 11 is a schematic illustration of certain layers of the solid-core plastic weight assembly of FIG. 10.

Unlike certain embodiments of a weight assembly 130 described above that include a cavity (see FIGS. 4B and 5B), in this embodiment, plastic shell 332 is formed around a solid core 242 formed of two or more alternating layers 346, 348. In one or more embodiments, a first layer 346 may be formed of a plastic and a second layer may be formed of a weigh material 344. In one or more embodiments, weight material 344 may be metal. In one or more embodiments, metal weight material 344 may be formed of powdered metal, such that alternating layers 346, 348 of plastic and metal, respectively, may be 3D printed to form weigh assembly 130. Plastic shell 332 in this case may simply consist of the plastic layers 346 interleaved between metal layers 348. In other embodiments, each metal layer 348 may be formed of a middle portion 354 generally formed of metal with end portions 356 formed of plastic, such as is illustrated in FIG. 11. In particular, shown in FIG. 11 are illustrative first and second layers 346 and 348, spaced apart for clarity purposes. As seen, each of first layers 346 are formed of plastic. Second layer 348 is formed of a metal middle portion 354 with plastic end portions 356.

In any of the above described weight assemblies 130, 230, 330, the plastic shell may be disposed to plastically deform to around its weight material to prevent the weight material from migrating into a wellbore annulus or formation during perforating activities. The plastic shell may plastically deform by partially or fully melting around the weigh material to form a mass that can bind or encapsulate the weight material. In other embodiments, the weight assemblies 130, 230, 330, being formed of plastic, may be at least partially if not fully consumed by detonation of the perforating gun.

Thus, a downhole perforating gun assembly has been described. Embodiments of a downhole perforating gun assembly may generally include a charge tube in which a perforating charge is mounted, the charge tube having an outer diameter; a carrier tube in which the charge tube is positioned, the carrier tube having an inner diameter that is greater than an outer diameter of the charge tube so as to form an annular space between the carrier tube and the charge tube; at least one charge mounted in the charge tube; and a weight assembly positioned within at least the carrier tube, the weight assembly comprising: a weight material; a plastic shell at least partially disposed around the weight material. In other embodiments, the downhole perforating gun assembly may generally include a charge tube in which a perforating charge is mounted, the charge tube having an outer diameter; a carrier tube in which the charge tube is positioned, the carrier tube having an inner diameter that is greater than an outer diameter of the charge tube so as to form an annular space between the carrier tube and the charge tube; at least one charge mounted in the charge tube; and a weight assembly positioned within at least the carrier tube, the weight assembly comprising: a plastic shell; and a flowable weight material disposed within the plastic shell. In yet other embodiments, the downhole perforating gun may include a charge tube in which a perforating charge is mounted, the charge tube having an outer diameter; a carrier tube in which the charge tube is positioned the carrier tube having an inner diameter that is greater than the outer diameter of the charge tube so as to form an annular space between the carrier tube and the charge tube; at least one charge mounted in the charge tube; and a first weight assembly positioned within the carrier tube, the weight assembly comprising: a first weight material forming at least a portion of a solid core; and a plastic shell disposed at least partially around the solid core.

For any of the foregoing embodiments of a downhole perforating gun assembly, the assembly may include any one of the following elements, alone or in combination with each other:

The plastic shell fully encloses the weight material and is hollow to define a cavity within the plastic shell.

The weight material is a flowable weight material disposed within the cavity.

The flowable weight material is selected from the group consisting of a liquid and a granular material.

The weight material forms at least a portion of a solid core.

The solid core comprises plastic.

The solid core comprises weigh material suspended in plastic.

Plastic shell further comprises an integrally formed plastic fastener.

Plastic shell further comprises an integrally formed plastic clip extending from plastic shell.

Plastic shell further comprises an integrally formed plastic detonating cord guide.

The solid core comprises metal.

The solid core comprises a first plurality of layers of a first material and a second plurality of layers of a second material.

The first plurality of layers is plastic and the second plurality of layers is metal, and wherein the first and second plurality of layers are interleaved with one another.

The first plurality of layers at least partially forms the plastic shell.

The flowable weight material is selected from the group consisting of a liquid and a granular material.

A rotation mechanism engaging said charge tube and disposed to rotate said charge tube about a charge tube axis of rotation, wherein the weight assembly is disposed within the charge tube.

The charge tube is formed of an elongated cylinder wall defined along the axis of rotation, with a access window formed in the cylinder wall at a first radial location about the axis and an extension window formed in the cylinder wall at a second radial location spaced radially apart from the first radial location, wherein the weight assembly is mounted in the charge tube so that a portion of the weight assembly extends through the extension window into the annular space between the carrier tube and the charge tube.

The extension window comprises a first extension window and a second extension window with a rib formed between the first and second extension windows, and the weight assembly extends from each of the first and second extension widows so as to straddle the rib, thereby at least partially securing the weight assembly in the charge tube.

The solid core comprises a first plurality of layers of a first material and a second plurality of layers of a second material, wherein the first plurality of layers is plastic and the second plurality of layers is sintered metal, and wherein the first and second plurality of layers are printed on one another.

The solid core comprises metal and the plastic shell encases the metal solid core.

The charge tube is formed of an elongated cylinder wall defined along the axis of rotation, with at least a first charge, a second charge and a third charge mounted in the charge tube, the first and second charged spaced apart from one another a first length and the second and third charge spaced apart from one another a second length different than the first length, wherein the first weight assembly is positioned in the charge tube and extends substantially between the first and second charges, the perforating gun assembly further comprising a second weight assembly positioned within the carrier tube, the second weight assembly comprising: a weight material forming at least a portion of a solid core; and a plastic shell disposed at least partially around the solid core, wherein the second weight assembly is positioned in the charge tube and extends substantially between the second and third charges.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

What is claimed is:

1. A downhole perforating gun assembly, comprising:

a charge tube in which a perforating charge is mounted, the charge tube having an outer diameter;

a carrier tube in which the charge tube is positioned, the carrier tube having an inner diameter that is greater than an outer diameter of the charge tube so as to form an annular space between the carrier tube and the charge tube;

at least one charge mounted in the charge tube; and a weight assembly positioned within at least the carrier tube, the weight assembly comprising:

a weight material;

a plastic shell at least partially disposed around the weight material.

2. The perforating gun assembly of claim 1, wherein the plastic shell fully encloses the weight material and is hollow to define a cavity within the plastic shell.

3. The perforating gun assembly of claim 2, wherein the weight material is a flowable weight material disposed within the cavity.

4. The perforating gun assembly of claim 3, wherein the flowable weight material is selected from the group consisting of a liquid and a granular material.

5. The perforating gun assembly of claim 1, wherein the weight material forms at least a portion of a solid core.

6. The perforating gun assembly of claim 5, wherein the solid core comprises plastic.

7. The perforating gun assembly of claim 6, wherein the solid core comprises weigh material suspended in plastic.

8. The perforating gun assembly of claim 5, wherein the solid core comprises metal.

9. The perforating gun assembly of claim 5, wherein the solid core comprises a first plurality of layers of a first material and a second plurality of layers of a second material.

10. The perforating gun assembly of claim 9, wherein the first plurality of layers is plastic and the second plurality of layers is metal, and wherein the first and second plurality of layers are interleaved with one another.

11. The perforating gun assembly of claim 10, wherein the first plurality of layers at least partially forms the plastic shell.

12. A downhole perforating gun assembly, comprising:

a charge tube in which a perforating charge is mounted, the charge tube having an outer diameter;

a carrier tube in which the charge tube is positioned, the carrier tube having an inner diameter that is greater than an outer diameter of the charge tube so as to form an annular space between the carrier tube and the charge tube;

at least one charge mounted in the charge tube; and a weight assembly positioned within at least the carrier tube, the weight assembly comprising:

a plastic shell; and a flowable weight material disposed within the plastic shell.

13. The perforating gun assembly of claim 12, wherein the flowable weight material is selected from the group consisting of a liquid and a granular material.

14. The perforating gun assembly of claim 12, further comprising a rotation mechanism engaging said charge tube and disposed to rotate said charge tube about a charge tube axis of rotation, wherein the weight assembly is disposed within the charge tube.

15. The perforating gun assembly of claim 14, wherein the charge tube is formed of an elongated cylinder wall defined along the axis of rotation, with an extension window formed in the cylinder wall at a second radial location spaced radially apart from a first radial location, wherein the weight assembly is mounted in the charge tube so that a portion of the weight assembly extends through the extension window into the annular space between the carrier tube and the charge tube.

16. The perforating gun assembly of claim 15, wherein the extension window comprises a first extension window and a second extension window with a rib formed between the first and second extension windows, and the weight assembly extends from each of the first and second extension widows so as to straddle the rib, thereby at least partially securing the weight assembly in the charge tube.

17. A downhole perforating gun assembly, comprising:

a charge tube in which a perforating charge is mounted, the charge tube having an outer diameter;

a carrier tube in which the charge tube is positioned the carrier tube having an inner diameter that is greater than the outer diameter of the charge tube so as to form an annular space between the carrier tube and the charge tube;

at least one charge mounted in the charge tube; and a first weight assembly positioned within the carrier tube, the weight assembly comprising:

a first weight material forming at least a portion of a solid core; and a plastic shell disposed at least partially around the solid core.

18. The perforating gun assembly of claim 17, wherein the solid core comprises a first plurality of layers of a first material and a second plurality of layers of a second material, wherein the first plurality of layers is plastic and the second plurality of layers is sintered metal, and wherein the first and second plurality of layers are printed on one another.

19. The perforating gun assembly of claim 5, wherein the solid core comprises metal and the plastic shell encases the metal solid core.

20. The perforating gun assembly of claim 17, wherein the charge tube is formed of an elongated cylinder wall defined along a axis of rotation, with at least a first charge, a second charge and a third charge mounted in the charge tube, the first and second charged spaced apart from one another a first length and the second and third charge spaced apart from one another a second length different than the first length, wherein the first weight assembly is positioned in the charge tube and extends substantially between the first and second charges, the perforating gun assembly further comprising a second weight assembly positioned within the carrier tube, the second weight assembly comprising: a weight material forming at least a portion of a solid core; and a plastic shell disposed at least partially around the solid core, wherein the second weight assembly is positioned in the charge tube and extends substantially between the second and third charges.

* * * * *